US008985012B2

(12) United States Patent
Yiannakou

(10) Patent No.: US 8,985,012 B2
(45) Date of Patent: Mar. 24, 2015

(54) LEATHER PRINTING

(71) Applicant: Codus Holdings Limited, Nicosia (CY)

(72) Inventor: Pantelis Yiannakou, Limassol (CY)

(73) Assignee: Codus Holdings Limited (CY)

( * ) Notice: Subject to any disclaimer, the term of this patent is extended or adjusted under 35 U.S.C. 154(b) by 115 days.

(21) Appl. No.: 13/798,252

(22) Filed: Mar. 13, 2013

(65) Prior Publication Data

US 2013/0239833 A1 Sep. 19, 2013

Related U.S. Application Data

(60) Provisional application No. 61/610,531, filed on Mar. 14, 2012.

(51) Int. Cl.

| | |
|---|---|
| ***B41F 17/00*** | (2006.01) |
| ***B41L 35/14*** | (2006.01) |
| ***B41F 31/00*** | (2006.01) |
| ***B41M 5/00*** | (2006.01) |
| ***B41J 3/407*** | (2006.01) |
| ***B41J 11/00*** | (2006.01) |
| ***C14B 1/56*** | (2006.01) |
| ***C14B 1/28*** | (2006.01) |

(52) U.S. Cl.

CPC ..... *B41F 31/002* (2013.01); *B41M 5/0047* (2013.01); *B41M 5/0076* (2013.01); *B41J 3/407* (2013.01); *B41J 11/0015* (2013.01); *B41J 11/002* (2013.01); *C14B 1/56* (2013.01); *B41M 5/0017* (2013.01); *C14B 1/28* (2013.01)

USPC ..... 101/35; 101/488

(58) Field of Classification Search

USPC ..... 101/35, 41, 487, 488

See application file for complete search history.

(56) References Cited

U.S. PATENT DOCUMENTS

| | | | | | |
|---|---|---|---|---|---|
| 3,728,298 | A | * | 4/1973 | Hartmann | 524/317 |
| RE29,206 | E | * | 5/1977 | Jaffa | 101/407.1 |
| 5,580,410 | A | * | 12/1996 | Johnston | 156/240 |
| 5,676,707 | A | * | 10/1997 | Kuwabara et al. | 8/436 |
| 5,858,514 | A | | 1/1999 | Bowers | |
| 8,350,880 | B2 | * | 1/2013 | Dinescu et al. | 347/217 |
| 2006/0003149 | A1 | * | 1/2006 | Ming-Chung | 428/195.1 |
| 2008/0008864 | A1 | | 1/2008 | Itoh | |

FOREIGN PATENT DOCUMENTS

| | | |
|---|---|---|
| GB | 2379188 | 3/2003 |
| WO | 01/32434 | 5/2001 |
| WO | 2006/129604 | 12/2006 |
| WO | 2009/014701 | 1/2009 |

* cited by examiner

*Primary Examiner* — Ren Yan
(74) *Attorney, Agent, or Firm* — DLA Piper LLP (US)

(57) ABSTRACT

An apparatus for printing leather including an ink acceptor applicator that applies ink directly onto a surface of the leather; an ink applicator that applies ink to the ink acceptor and/or the leather surface; an additive applicator that applies additive onto the ink acceptor, the ink and/or the leather surface; a barrier having a surface configured to contact the acceptor, ink and additive on the leather surface; and a heater that heats the surface of the barrier to a predetermined temperature or a temperature within a selected temperature range such that the barrier, which is substantially impervious to the ink and has a melting point higher than the select temperature range, contacts at least the acceptor ink and additive on the surface directly to liquefy the acceptor ink and additive into the leather and the acceptor, ink and additive fuses and penetrates into the leather.

17 Claims, 18 Drawing Sheets

Storage / Dehydration Unit

Leather is stacked in a sealed unit, heat is pumped in, water vapor is pumped out.

Specifications

| | |
|---|---|
| Table width: | 1,800cm |
| Line length: | 7m |
| Printing resolution: | 300 dpi to 1,200 dpi |
| Productivity: | 30,000 sq ft per day |
| Inks: | High preformance, water based pigment. |
| Thickness range: | 1mm to 8mm |
| Minimum size: | 1 x 1 (= 1sq ft) |
| Maximum size: | 6 x 7 (=42sq ft) |
| Colour gamut: | Base color of leather to black. |
| RIP/CS: | Pre-calibrated. |
| Environment: | Re-cycled heat and $CO_2$. Ecological inks. Fault management = lower wastage. |

Fig. 8

LEATHER PRINTING

RELATED APPLICATION

This is a non-provisional application of U.S. Application No. 61/610,531 filed Mar. 14, 2012, the subject matter of which is incorporated by reference.

TECHNICAL FIELD

This disclosure generally relates to apparatus for printing into leather, methods of printing into leather, computer programs and computer systems for performing such methods.

BACKGROUND

Leather is manufactured and finished on a commercial scale in tanneries. There are several different methods to tan leather. Two main variants are vegetable and chrome tan. Leather is generally colored by dyeing. Various finishes can be applied such as embossing or buffing. Those methods attempt to give some pattern, texture and depth to the surface, but have limited impact.

Leather printing can be difficult since ink generally does not bond well to a non-uniform, organic, complex substrate such as leather. Further, printing on leather is difficult due to non-uniformity of surface properties, e.g., shape, color, density, content (e.g. water, proteins, fats, oils and/or lacquer), pore concentration, flatness, thickness and surface roughness. Different regions of a hide may have different such properties due to differences in exposure to the sun. Thus, there is likely to be significant variation on a single hide as well as between hides of a batch. Techniques for printing on leather may suppress at least one usual property of leather, e.g., flexibility, surface roughness, appearance, feel (to human touch), breathability and/or absorption. One of the desirable characteristics of leather is flexibility. It is often used in places where it is required to bend and flex (e.g., footwear, seating, accessories, etc.). Printing onto the surface of leather is disadvantageous if the ink is weakly bonded and thus easily removed during normal wear and tear, or if the print cracks when flexed.

Additional difficulties may be encountered in printing on leather using printing techniques known in other technical fields involving printing on non-leather substrates if the ink molecules do not bind well with leather. For example, printing onto leather using printing techniques more commonly applied to paper may result in only some ink molecules binding to the leather so that the printed coloring/pattern is uneven and/or faint. Such coloring/patterning merely printed onto a leather surface may wear off easily, quickly and/or unevenly and/or have low light fastness and, thus, may not be durable.

There remains a need for a method of coloring or patterning leather by printing in a manner that minimizes impairment of at least one property of leather and preferably has advantages such as, inter alia, durability, high definition coloring/patterning, good resistance to heat/strain induced damage (e.g. reduced cracking), low transfer of color in wet conditions (i.e. low running of color dye/ink when wet), low cost and/or efficient (e.g. faster). Given the volumes of leather produced and finished each year, there is also a need for a fit-for-purpose industrial leather printing process operable in the harsh environment of a tannery or finishing plant.

The following disclosures are referred to:
GB2379188A;
WO/2006/129604; and
WO/01/32434,
for additional background.

BRIEF DESCRIPTION OF THE DRAWINGS

For a better understanding and to show how the process may be carried into effect, reference will now be made, by way of example, to the accompanying drawings, in which:

FIG. 8 is a table of selected possible specifications.

SUMMARY

Figure 1:
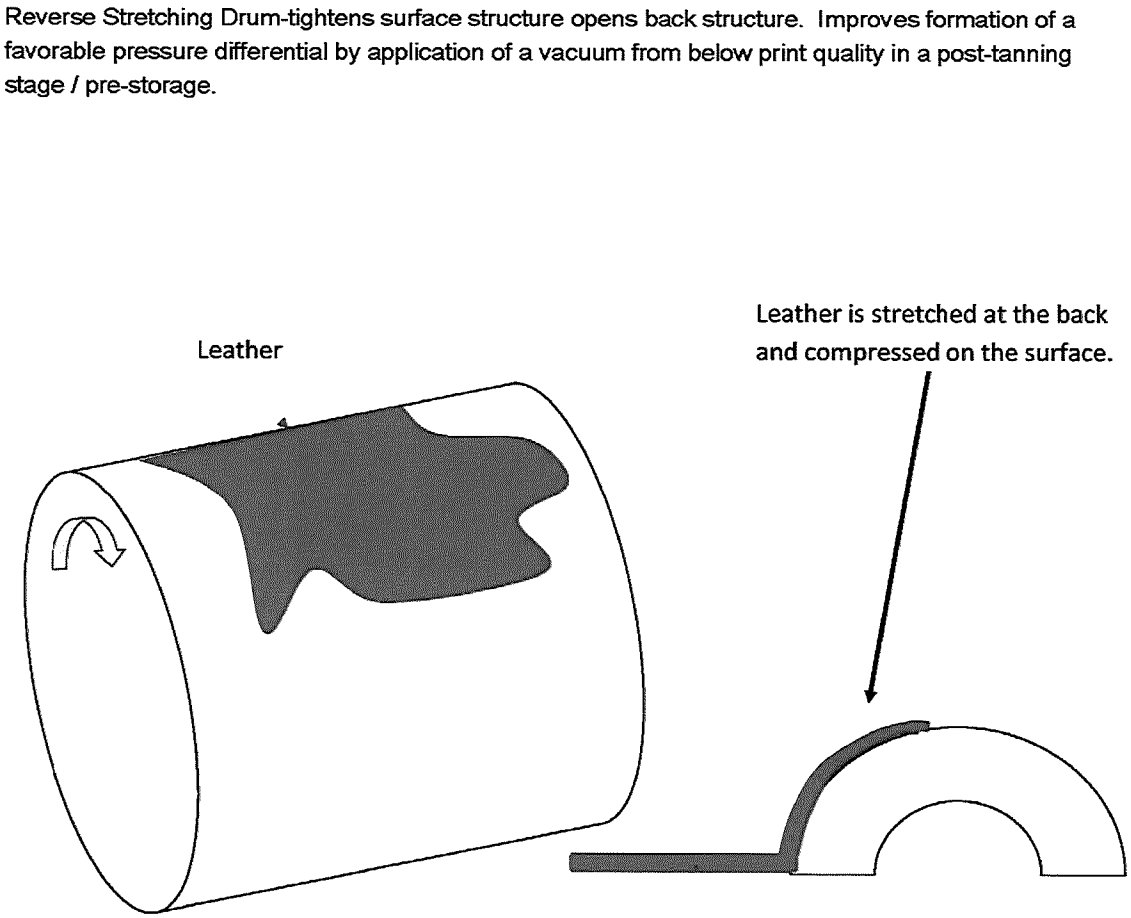
FIG. 1 schematically shows a reverse stretching drum used in a post-tanning stage, pre-storage stage of the process described in detail below, to tighten the leather surface structure, opening the back structure.
Figure 2:
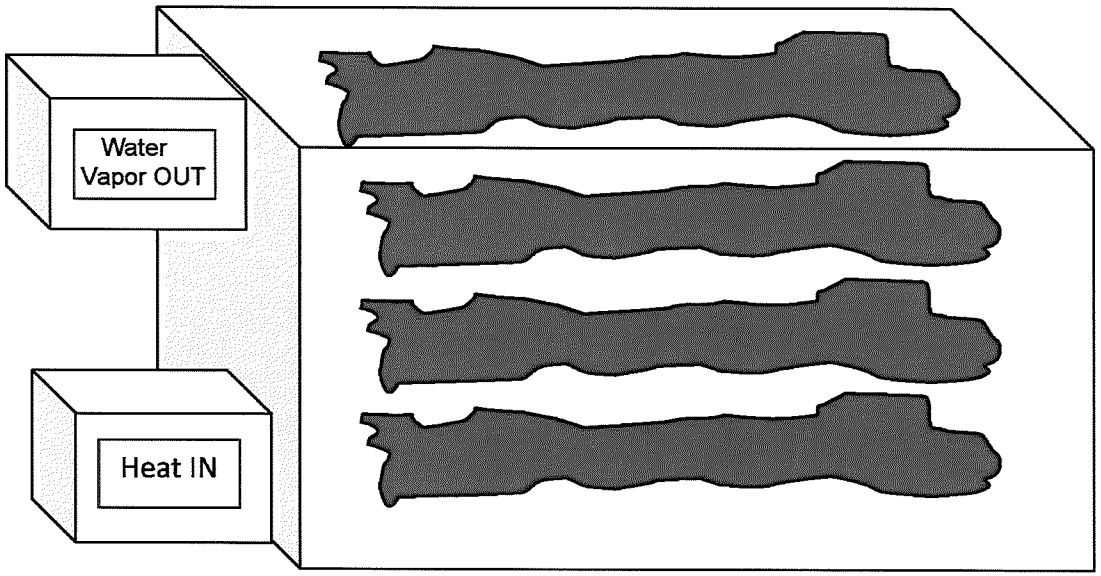
FIG. 2 schematically shows a storage/dehydration unit.
Figure 3:
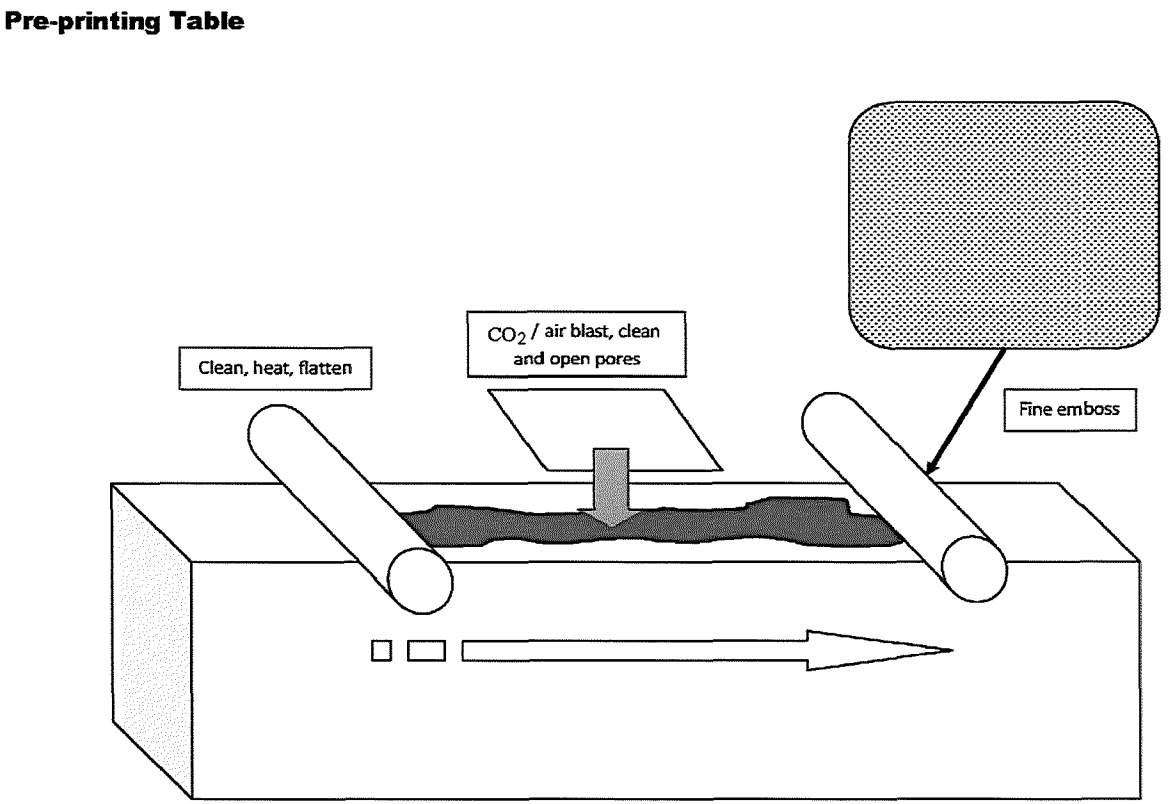
FIG. 3 schematically shows a pre-printing table.
Figure 4:
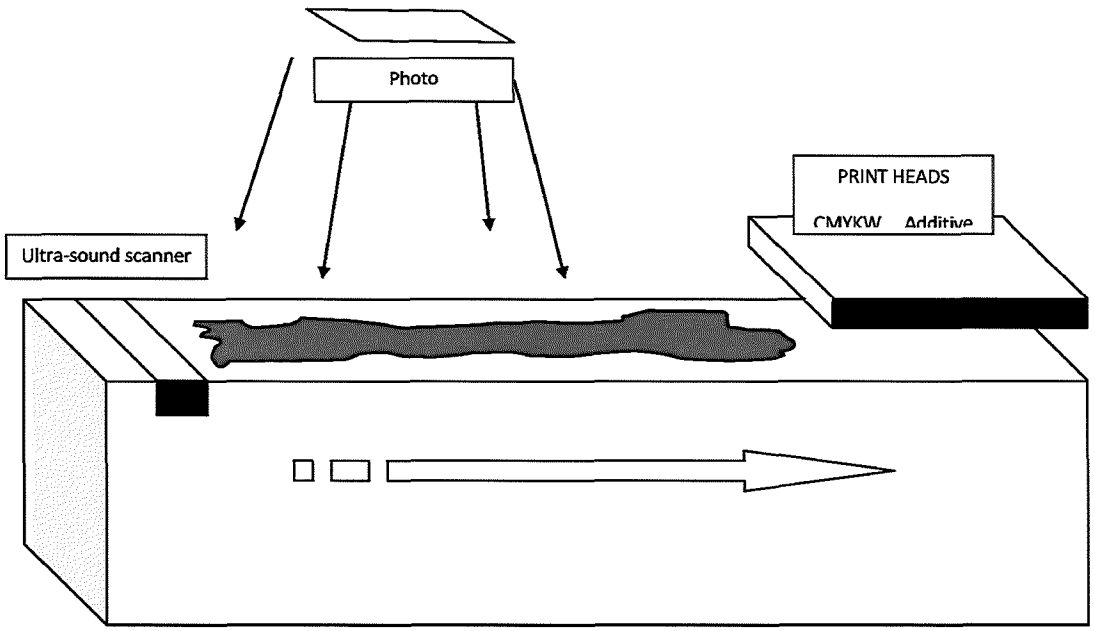
FIG. 4 schematically shows a scanning table.
Figure 5:
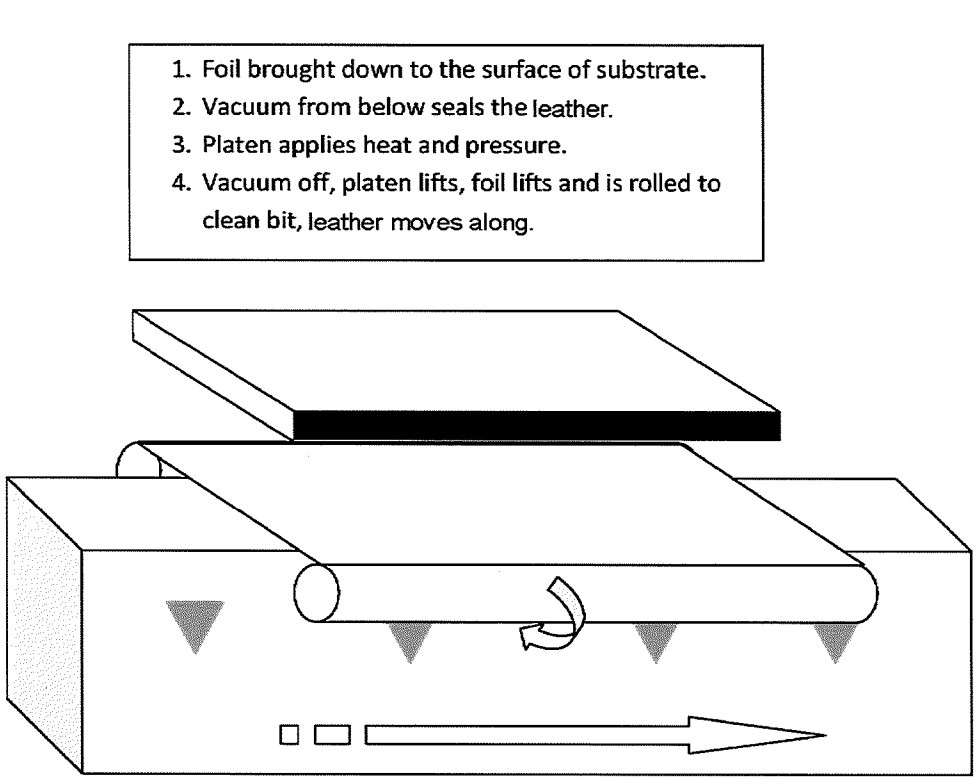
FIG. 5 schematically shows a printing step which may involve: (1) Foil/barrier brought down to the surface of the substrate; (2) Vacuum from below seals the substrate; (3) Platen applies heat and pressure; (4) Vacuum off, platen lifts, foil lifts and is rolled to clean bit, substrate moves along.
Figure 6:
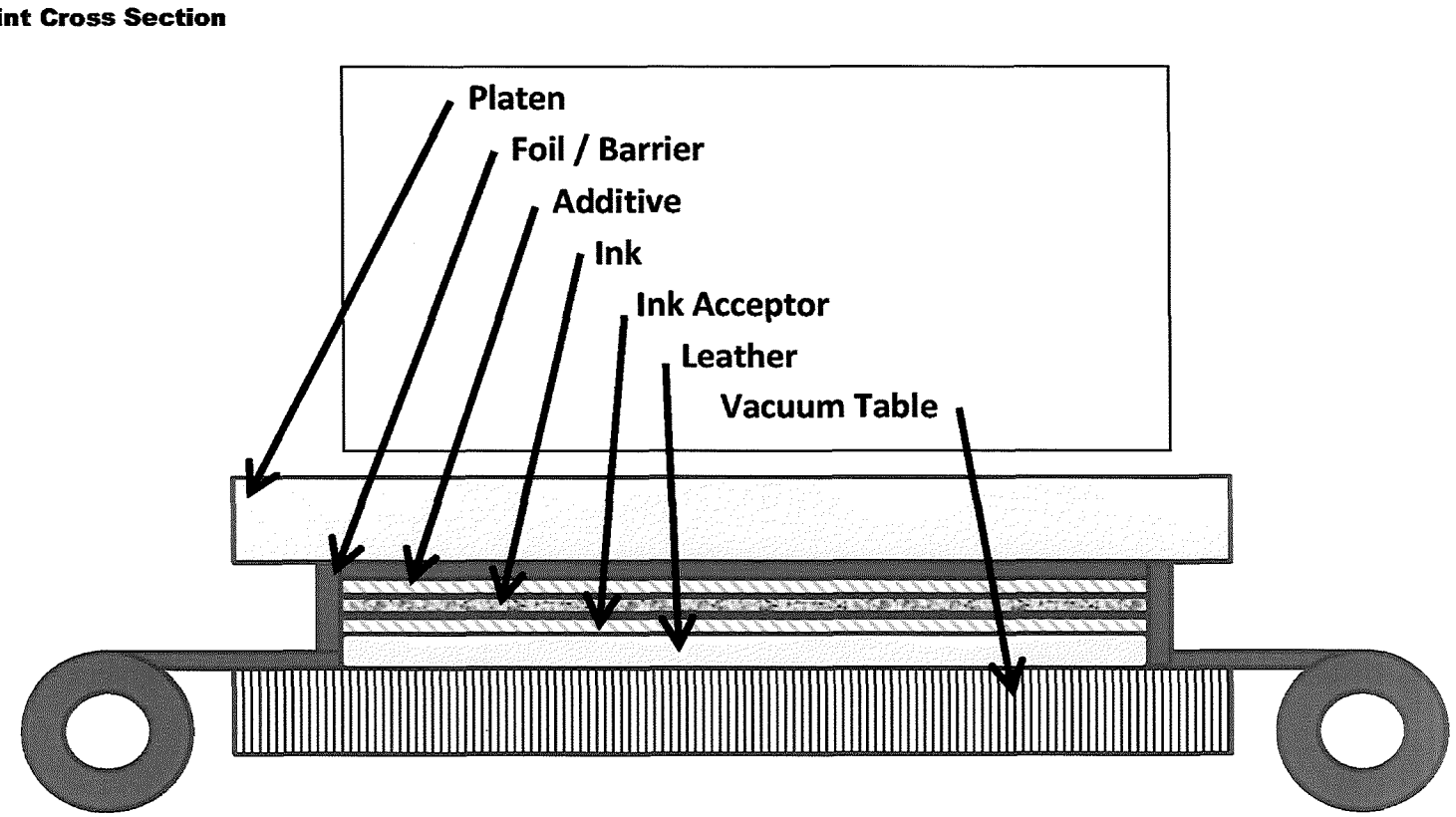
FIG. 6 schematically shows a printer cross section.
Figure 7:
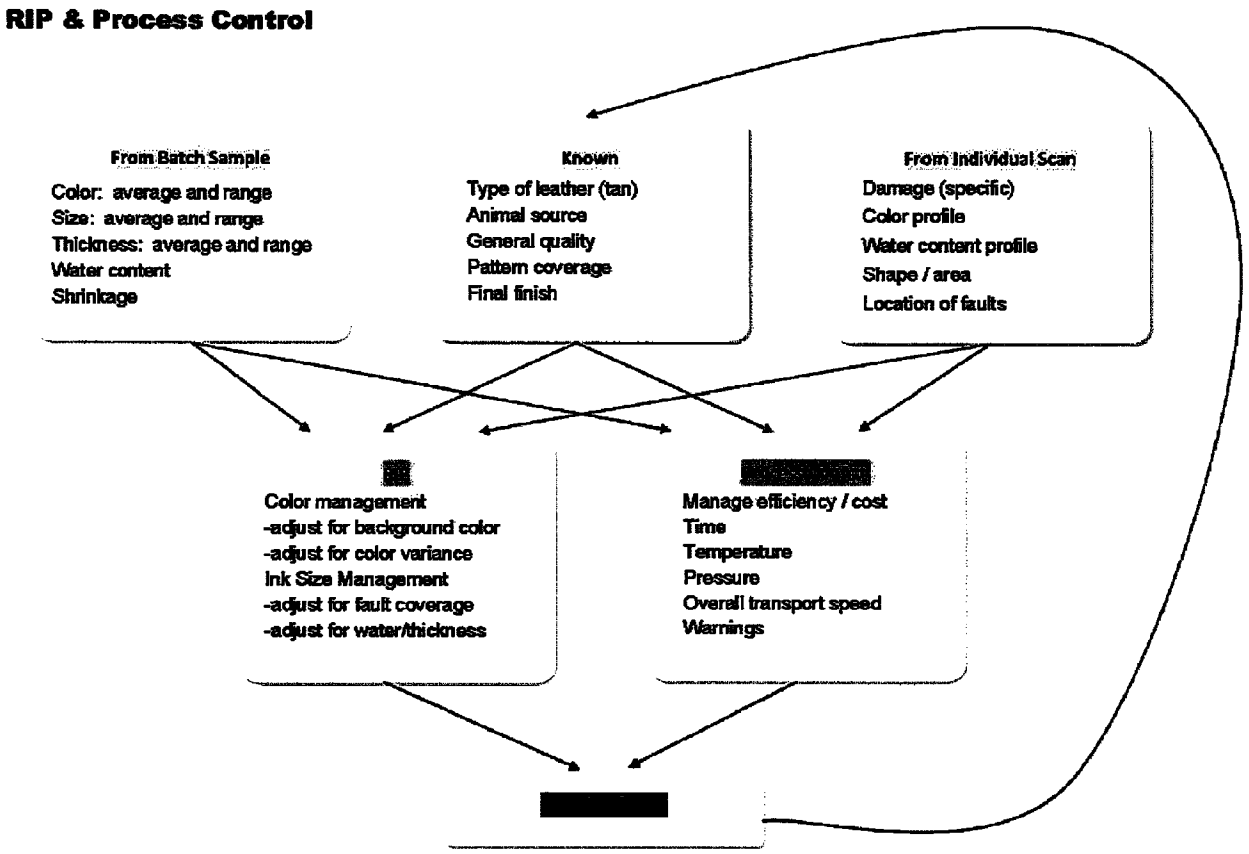
FIG. 7 is a flow diagram of RIP and process control.
Figure 9:
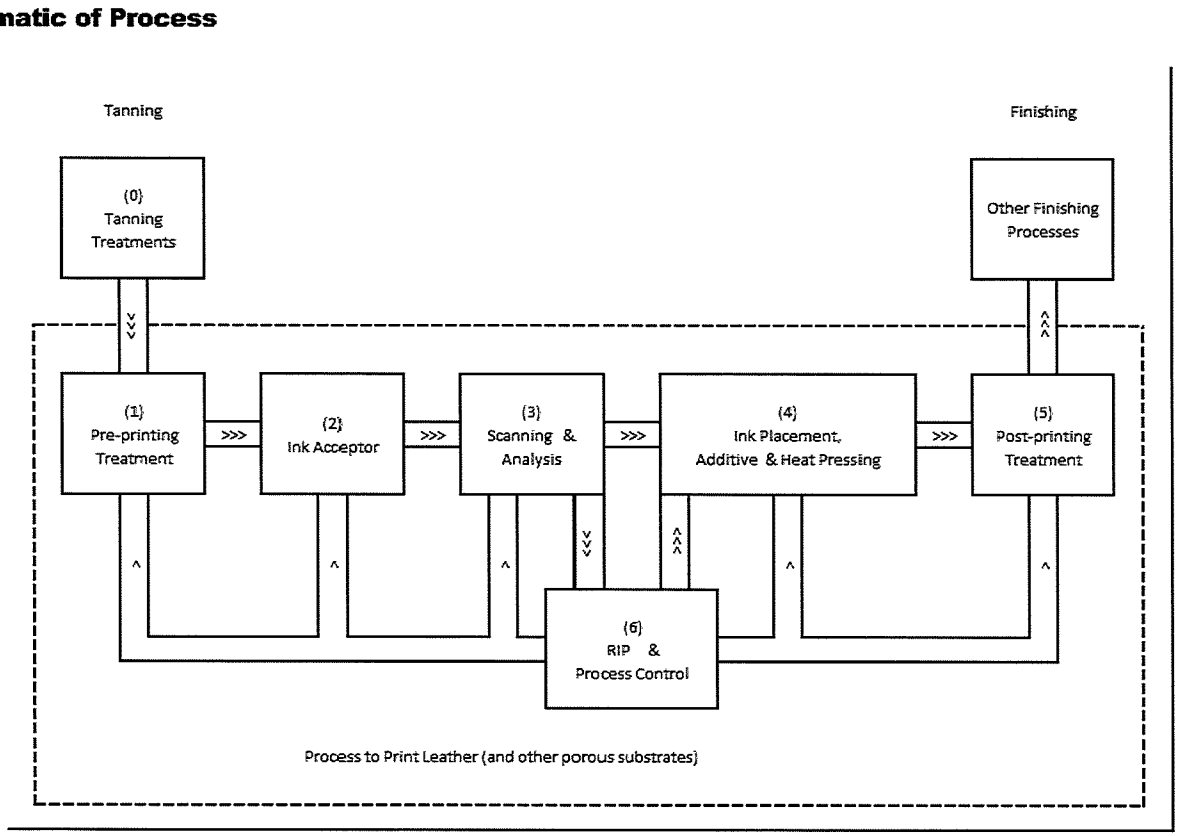
FIG. 9 shows a schematic of an example of a selected process.

I provide apparatus for printing leather including a device that applies an ink acceptor base coat directly onto a prepared surface of the leather, an ink applicator that applies ink onto the base coat and/or the surface of the leather, an additive applicator that applies additive directly onto the base coat, ink on the surface of the leather and/or the surface of the leather, a barrier having a surface configured to contact at least the additive and ink on the surface of the leather, and a heater that heats the surface of the barrier to a predetermined temperature or a temperature within a predetermined temperature range such that the barrier, which is substantially impervious to the ink and has a melting point higher than the predetermined temperature range, contacts the additive and ink on the surface directly to soften the additive and ink into the leather and the additive and ink penetrates into the leather.

I also provide methods of printing into leather including applying an ink acceptor base coat directly onto a surface of the leather, applying ink onto the base coat and the surface of the leather, applying an additive to the coating, the ink acceptor, the ink and the surface of the leather, heating a surface of a barrier which is substantially impervious to the ink to a predetermined temperature or a temperature within a predetermined temperature range, and contacting the heated barrier which has a melting point higher than the predetermined temperature range with at least the additive and ink on the surface directly to soften the applied additive and ink such that the ink penetrates into the leather.

I further provide computer programs that perform the printing methods in conjunction with the apparatus.

I still further provide computer systems including an input that inputs measurements of surface properties of a piece of leather, an output that outputs scanning results, data memory that stores the inputted measurements, a program memory storing processor control code, and a processor coupled to the input, the output, the data memory and the program memory that loads and implements the processor control code, wherein the code, when running, implements the printing methods.

DETAILED DESCRIPTION

It will be appreciated that the following description is intended to refer to specific examples of structure selected for illustration in the drawings and is not intended to define or limit the disclosure, other than in the appended claims.

I provide apparatus for printing into leather. The apparatus may include an ink acceptor applicator configured to apply ink acceptor base coat directly to the surface of the leather, an ink applicator configured to apply ink directly onto the base coat and/or the surface of the leather; an additive applicator configured to apply additive on the base coat, ink and/or on the surface of the leather; a heated press configured to heat the surface to a predetermined temperature or a temperature within a predetermined temperature range, the additive configured to contact the ink on the surface directly to soften and coat the leather such that the applied acceptor and additive-coated ink penetrates into the leather, with the additive forming a protective coating for the ink.

The apparatus may be configured as a flat-bed, roller printer or the like. A roller configuration may be faster, but there may be some misalignment due to relative movements of rollers on each side of the leather. Printing may involve coloring and/or patterning the leather. Printing "into" the leather means the ink enters the leather. The ink applicator may be one or more ink heads, which may be digitally controlled. Additionally or alternatively, the ink may first be applied to the additive and then to the leather so that the additive acts at least as part of the ink applicator. The ink acceptor may be a polyamide such as NYLON, preferably an aqueous suspension mix of NYLON 6, 12; NYLON 12 and NYLON 6, 10 and may be sprayed on in powder form or as a liquid such as a suspension. The additive may be a polyamide such as NYLON, for example, similar or identical to the ink acceptor, and may be sprayed on in powder form, as a liquid such as a suspension or may be on a dry sheet.

I also provide processes such as a representative process including the following steps 1-5:

1. Apply a base coat of ink acceptor;
2. Place ink in a selected position on a porous prepared substrate;
3. Coat with a fine layer of additive;
4. Heat quickly (such as in a few seconds) (not necessarily with any pressure, just enough to keep the additive/ink in place); and
5. Causing the ink acceptor, ink and additive to soften and penetrate the surface of the leather and filling the pores through capillary action, whereby the ink is trapped in the ink acceptor and additive and bonded into the leather.

Advantageously, the polyamide used both in the base coat top coat and the thickness used may be such that while it protects and bonds the ink to the leather, it does not inhibit key characteristics of the leather.

Penetration into the leather may be to a depth of at least about 0.0001-0.0040 mm below the surface, for example.

The lowest temperature of a predetermined temperature range may be higher than about 100° C. Additionally or alternatively, the highest temperature of the predetermined temperature range may be lower than about 220° C.

The apparatus may include a pressurizer configured to apply pressure directly onto the applied acceptor, additive and ink by pressing a heated barrier against the applied ink, preferably wherein the pressure is a predetermined pressure or is within a predetermined pressure range. The pressure may be a pressure of less than about 50 psi, preferably more than about 0 psi. The pressurizer may comprise the heat press with a non-stick barrier. The apparatus may be configured to apply the heated barrier to the applied acceptor, ink and additive for a length of time within a predetermined time length range or for a predetermined time length. The length of time may be less than or equal to about 2 minutes. The apparatus may be configured to apply the heated barrier several times.

The apparatus may be configured to dehydrate the leather by heating the leather to cause at least a portion of the water content of the leather to become steam, and comprising at least one of: a vacuum suction unit to suck the steam away from the leather; and an absorption unit to absorb the steam away from the leather. Such dehydration may be used as, e.g., preparation prior to printing or at the same time as pressing during printing. Otherwise, the water comes off as steam and may interfere with printing. Additionally or alternatively, there be performed some chemical pre-treatment of the leather prior to printing.

The apparatus may comprise a scanner that determines spatial variation of at least one property of the leather, wherein at least one property comprises liquid, protein and/or fat content, thickness, acidity, pore concentration, flatness, thickness, color and/or surface roughness. The scanner is preferably further configured to detect a fault in the leather. Additionally or alternatively, size and/or shape of the leather may be scanned. The liquid may be, e.g., water, oil, fat or the like. Acidity may be measured as a pH value.

The apparatus may include a printer that prints into leather, the printer comprising an adjustor that adjusts a total volume ink applied to a point or location of the leather, and/or size and/or color of an ink droplet to be deposited on the leather, the adjustment dependent on a result of the determination of spatial variation of the at least one property of the leather. The adjustor may be configured to increase the ink droplet size and/or the total volume of ink at a region of the leather having greater damage or higher water content than a neighboring region of the leather. The printer may be a flat-bed or roller printer and, preferably, provides digitally controlled ink droplet deposition.

The barrier and heat press may be configured, preferably indented, to hold the ink substantially in a fixed position during application of heat.

The methods of printing into leather may include applying ink acceptor directly onto a surface of the leather; applying ink onto the coated surface of the leather, applying an additive to the ink; heating a surface of a barrier to a predetermined temperature or a temperature within a predetermined temperature range; contacting the heated barrier with the ink acceptor, ink and additive on the surface directly to soften the acceptor, ink and additive into the leather such that the applied ink penetrates into the leather, the barrier being substantially impervious to the acceptor, ink and additive and having a melting point higher than the predetermined temperature range.

The method may also include mechanically treating the leather before application of the ink, preferably by indenting the leather to hold the ink substantially in a fixed position during application of additive and heat.

I also provide computer programs for performing the above method as well as computer systems including an input that inputs measurements of surface properties of a piece of leather; an output that outputs scanning results; data memory that stores the inputted measurements; a program memory storing processor control code; and a processor coupled to the input, to the output, to the data memory and to the program memory that loads and implements the processor control code, the code comprising code to, when running, implement the above method.

Of course, any number of all of the above aspects may be combined in any permutation.

The following describes processes and concepts applicable to industrial leather printing machines. Further, the following description relates to leather substrates to be printed into. However, the following is further applicable to printing into other, non-leather material. Furthermore, my methods and apparatus may be suited to both vegetable tanned leather and chrome tanned leather.

Figure 18:
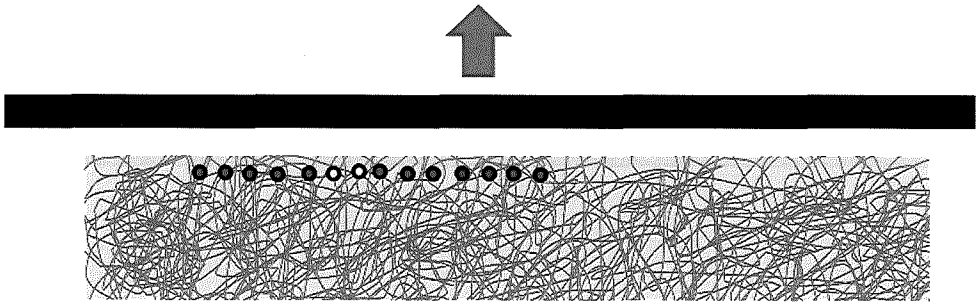
FIG. 18 schematically shows that heat softens the additive and ink layer which then penetrates the surface of the leather through capillary action.

Experiments on printing ink into leather have shown that a selected combination of pressure, temperature and/or time is sometimes required. The acceptor and the thickness of the acceptor is also a variable. The additive and the thickness of the additive is also a variable. When at least one of these properties is increased above a selected value, the amount of ink entering into the leather increases rapidly. This suggests that the ink enters the leather by capillary action: if the acceptor, ink and additive is pressed into the leather by a barrier (e.g., a metal, ceramic plate, foil and/or paper) impervious to the acceptor, ink and additive, then there may be substantially nowhere else for the combined liquid to be transferred to except into the leather, which in relation to the liquid is porous relative to the barrier. This has been confirmed by electron microscope images that show that the printed ink is found in the leather below the surface of the leather as shown in FIG. 18.

The ink is printed more permanently than if it were found merely on the surface of the leather. The barrier may be arranged to receive the additive and ink before the leather and/or plate is moved laterally to face each other ready for application of the additive and ink to the leather. Alternatively, the plate having the additive and ink on one side (e.g., a side facing upwardly) may be rotated so that that side faces the leather (e.g., the side then faces downwardly towards the leather). The barrier may comprise a solid plate of any desired thickness.

Additionally, the barrier may comprise a metal foil or layer for direct contact with the leather. Such a foil, paper or ceramic layer may be provided on a belt configured to rotate around drums so that additive and ink can be applied to one side of the barrier configuration before that side is rotated to face the coated leather for application of the ink to the leather. It is possible to use transfer medium to apply additive and ink to leather.

The dependence on temperature and time of successful printing confirms that capillary action appears to take place as described above and that diffusion of ink acceptor, the liquid additive and ink may therefore be a dominant process for entry of the ink into leather. The transfer medium may be standard heat transfer paper (comprising plastic having two layers, a polymer and a thin polyamide additive) as an ink carrier, standard HP pigment based ink and pressure set at a constant about 0 to about 50 psi to print on about 50 off cuts of 3 mm thick unfinished pink vegetable tanned leather of area about 10 cm×10 cm.

Figure 10A:
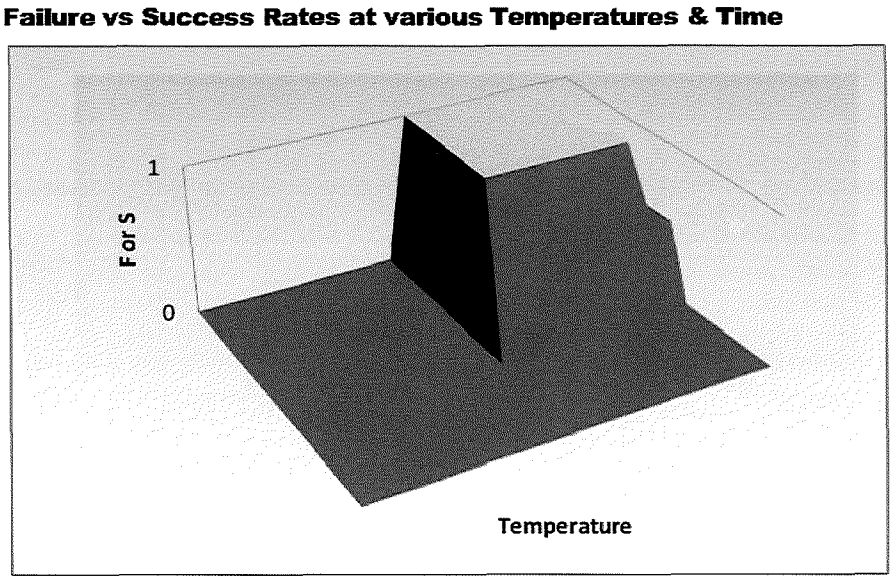
FIGS. 10(*a*) and 10(*b*) show graphs of variation of success and failure rates with temperature.
Figure 10B:
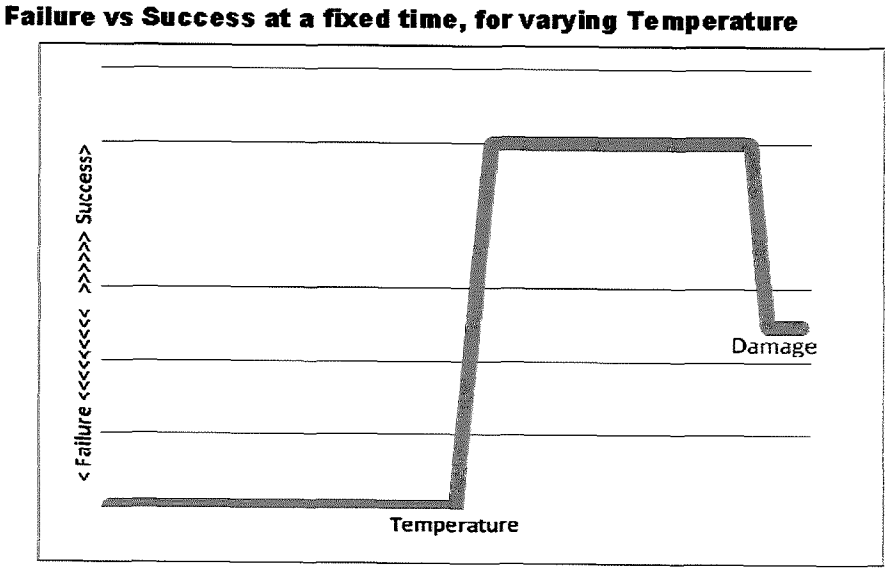

Various combinations of temperature and times at the same pressure were tested. FIGS. 10(*a*) and 10(*b*) show how the success (1 in FIG. 10*a*) and failure (0 in FIG. 10*a*) rates varied with temperature. Success was achieved when the transfer of ink into the leather occurred across the leather sample with good penetration. In unsuccessful tests, there was no transfer of ink into the leather (i.e., no penetration), an undefined/unclear result (e.g., non-uniform penetration), or damage (e.g., drying, shrinking, and/or deformation of the leather, usually due to excessive heat and/or excessive time).

Figures 11A, 11B:
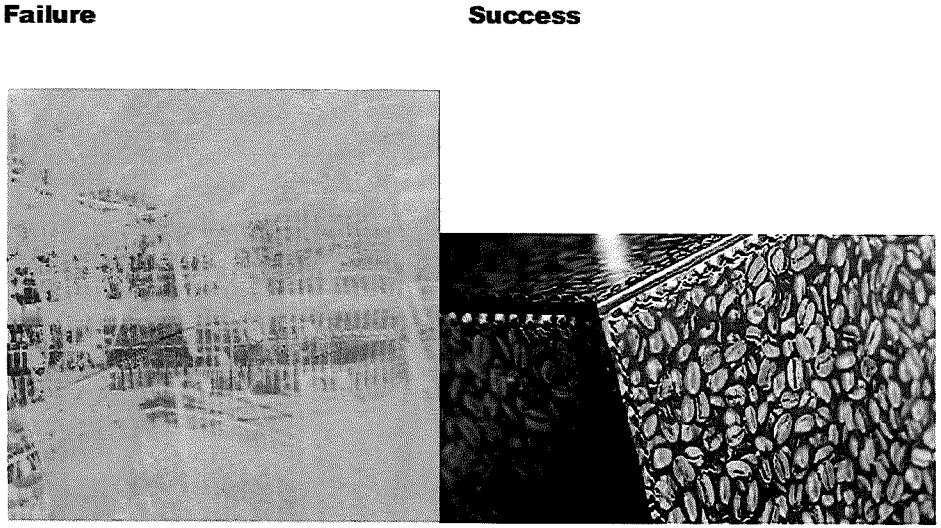
FIGS. 11(*a*) and 11(*b*) show photographs of test results classed as (a) failure (b) success.

Of interest, the additive and ink in successful instances penetrated into the leather, filling the pores, rather than merely remaining on the surface of the leather. Furthermore, temperature and time were strongly determinant of success, both associated with substantially step functions of success rate as a function of temperature or time similarly as shown in FIGS. 10(*a*) and 10(*b*). Thus, in these tests almost no partial penetration was seen. Images of test results are shown on FIG. 11(*a*): failure and 11(*b*): success. Cross sections of printed leather were examined using a high powered microscope. The additive and ink was clearly seen to be "in" the surface as opposed to "on" the surface, i.e., to penetrate to a depth of at least about 0.002 mm, in cases several micrometers, for example.

The following describes a mechanism that may take place and which may be described as "forced penetration". The resulting print effect may be termed as a "digital tattoo", as the ink is embedded into the surface of the substrate.

Figure 12:
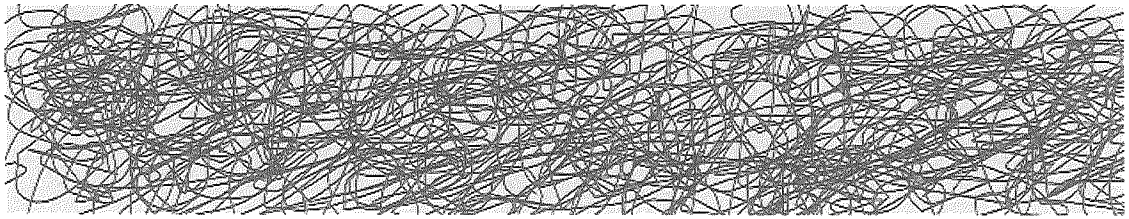
FIG. 12 schematically shows a surface of leather, wherein lines represent the fibrous/porous nature of the substrate.

A suitably prepared substrate with a coating of polyamide ink acceptor is presented for printing as shown in FIG. 12. The substrate may be supported by a base with holes to allow for a vacuum to be applied. The vacuum holds the substrate in place and removes excess water vapor which may inhibit printing. The lines show the "fibrous" nature of the leather which is a factor in many of the useful characteristics of the leather. However, all of the drawings herein are merely for the purposes of aiding understanding, i.e., are diagrammatic and are therefore not limited to specific relative dimensions or components.

Figure 13:
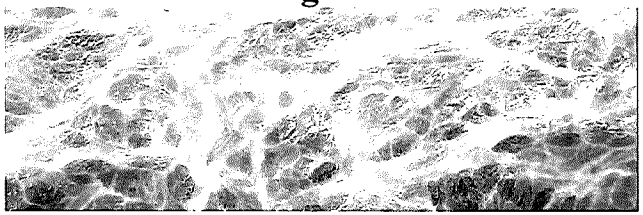
FIG. 13 is a microphotograph of a cross section of a leather substrate.
Figure 14:
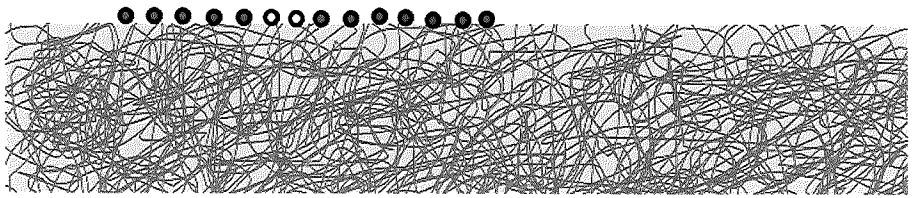
FIG. 14 schematically shows ink deposited on the surface of the substrate shown in FIG. 12.

FIG. 13 shows the internal structure of leather at high magnification. Ink droplets are deposited on the substrate to form the desired image shown in FIG. 14. The ink droplets do not initially penetrate the leather, but rather remain on the surface, held in place by the ink acceptor. The ink can be deposited by various methods, depending on the desired definition of the image.

Figure 15:
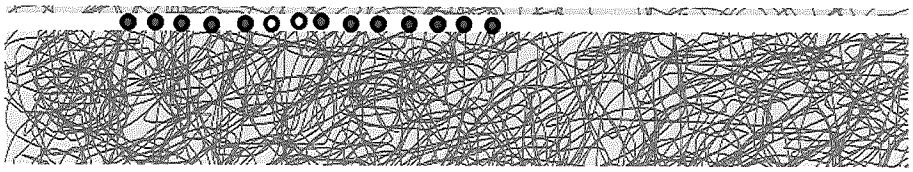
FIG. 15 schematically shows a very fine layer of additive deposited onto the ink and surface of the substrate of FIG. 14.

A very fine layer of additive such as a polyamide is deposited on the surface, covering the deposited ink and any non-ink covered areas in FIG. 15. The ink acceptor may be sprayed on as a powder or in a liquid suspension. The additive may be sprayed on as a powder, or may be deposited in a liquid form.

The ink acceptor coating may be very fine, typically less than 0.0050 mm. The additive coating may be very fine, typically less than 0.0050 mm.

Figure 16:
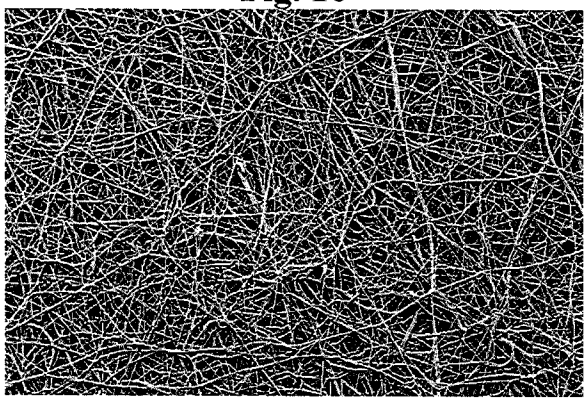
FIG. 16 is a microphotograph of the surface of a leather substrate.

The internal composition of the polyamide of both the ink acceptor and the additive is preferably similar to the internal composition of the leather as shown in FIG. 16. It is a "nest" of long chains and means both the leather and the polyamide have similar characteristics, i.e., flexibility, porosity, absorption, strength and the like.

Figure 17:
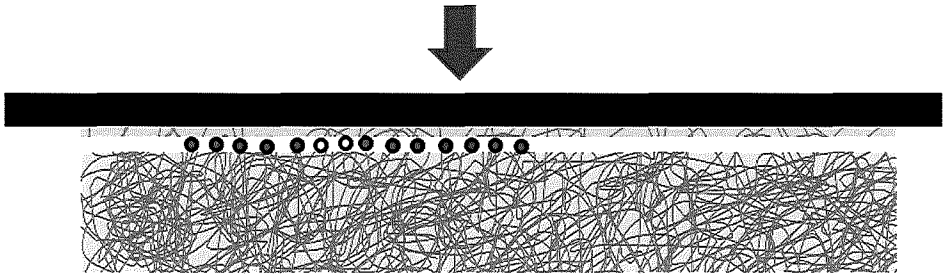
FIG. 17 schematically shows the leather/ink/additive pressed with heat and pressure for a pre-determined time.

The acceptor, ink and additive may then be heat pressed using a platen or a non-stick barrier and then a platen as shown in FIG. 17. As a result, the heat softens the acceptor, ink and additive which then penetrates the porous surface of the substrate while substantially remaining in position. While a metal platen as the barrier is sufficient for heat transfer, it is preferable that heat and pressure are imparted to the acceptor, ink and additive on the surface of the substrate quickly and without lateral movement, particularly if the printing is to be applied at industrial speeds. Before heat-pressing, the ink on the surface is preferably in a dry state (solid). When heat and pressure is applied, the acceptor, ink and additive soften briefly and then mix together. The pressure from the barrier, in addition to capillary action, draws the acceptor, ink and additive mixture to penetrate the porous substrate. Substantially, the ink does not spread out as there is an impervious barrier above and substantially equal pressure from the sides. So the acceptor, ink and additive diffuses directly downwardly in the position it was placed on the surface.

As shown in FIG. 18, when solid acceptor, ink and additive is exposed to heat and pressure, it appears to soften and penetrate. It may be held in position by the barrier in the form of a foil under pressure from a platen. The pressure differential across the leather may be increased by a vacuum applied from the base of the leather. Such a vacuum may also remove steam generated from water in the leather. The acceptor, ink and additive re-solidifies in the leather and heat may "fix" the ink so that it bonds with the leather material. Thus, "forced penetration" may occur. The heat and pressure may be applied multiple times, to further soften and fix the mixture.

For the process to work effectively, several factors should simultaneously be met. The leather should be prepared in the right way, and the surface of the leather should be open (unfinished). The ink acceptor should be applied to the correct thickness. The ink should be of suitable composition. The additive should be correct so that, when in liquid form, along with the acceptor and ink, it is of sufficient viscosity to penetrate the leather. The pressure, temperature and time are also important to obtain a stable, robust result.

Figure 19:
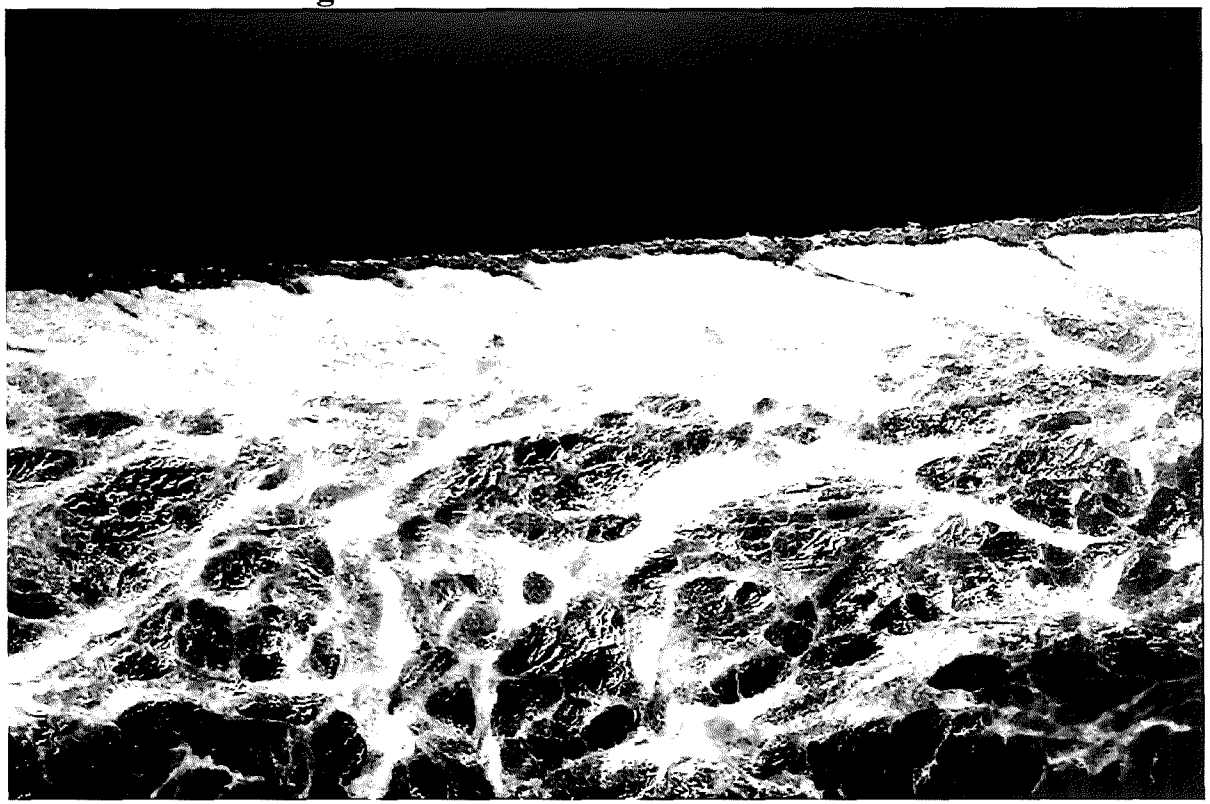
FIG. 19 is a microphotograph of a cross section of printed leather.

FIG. 19 shows a high magnification cross section of a piece of printed leather. The very top (dark) layer is about 0.0030 mm thick. It is the acceptor, ink and additive after it has softened and penetrated into the leather. "Streaks" of the acceptor, ink and additive mix have filled the pores.

The substrate, e.g., leather is preferably presented in the optimal condition for accepting the ink. That means that the leather is preferably porous to the optimum degree (preferably also the fibers of the leather are clear). The surface is preferably "tight" as fine surface structure will allow higher definition printing. As mentioned above, the water content is a further consideration, as the process generates steam in the leather which may impede printing. Other factors such as pH level, fat content, color and the like may similarly have an impact on the final print quality. Generally, finished leather will not be porous to the degree required for the above forced penetration to occur (though some finished leather may be). "Finished" may mean, e.g., a protective coating has been applied, stain-proofed, water-proofed, color dyed, grain embossed, water-proofed and/or fire-retarded. Thus, it may be preferable that the leather has been prepared in a certain way, e.g., omitting certain finishing steps before the printing of the process is applied, e.g., not tanned by certain dyes. Thus, preferably, the tanned leather is unfinished and undyed and has not been subject to mechanical treatments that smooth, sand, buff or otherwise re-finish the surface and may interfere with the pore structure of the leather. However, the tanning process may be modified to improve printability of the leather by mechanical, chemical and/or biological treatments such as by a tanning additive, e.g., oxalic acid or sodium hydride to bleach or lighten the color, mechanical reverse stretching over shallow drums to open pores, and/or drying in a heated jet of $CO_2$ to open the pores.

The ink is preferably of a type, e.g., HPP (high performance pigmented), or a flexible UV cured ink preferably with selected properties such as molecule size<1.0 um and ink volume concentration>20%. Levels of lubricants and resins may be controlled for different types of leather. Good results have been achieved using pigment based inks. In this regard, pigment molecule size and penetration temperature are preferably adjusted for improved printing.

The ink is preferably placed on the leather using known inkjet technology. There are at least two options for ink placement. First, the ink may be placed directly onto the coated, prepared substrate. The ink acceptor is applied to the substrate prior to ink placement so that the ink is held in place. Such ink acceptor may reduce smudging of the image. Alternatively or additionally, the ink may be applied to the barrier which may have ink drop "holders" e.g., dimples on the surface of the barrier; e.g., the barrier may be nano-engineered to have a matte texture suitable to hold the ink in place, and/or the leather may be indented, e.g., to roughen the surface of the leather to reduce mobility of the ink on the leather surface. Such indenting may be performed by moving a roller having a dimpled surface over the surface of the leather (e.g., by roll-embossing a very fine pattern of indents on the surface of the leather, for example, at a density of 10 k ipis=about 600 dpi so that it obtains a uniform matte finish. Such embossing may be carried out at about 120° C., for example, which may reduce the water content of the leather. Furthermore, such roll-embossing may substantially correct thickness variances of the leather. Preferably, the indentations are non-permanent deformations of the leather surface, e.g., the leather naturally returns to its original, non-indented state after, e.g., a few seconds or minutes.

Regarding control and placement of the ink, where inkjet printing is used in one example, the ink droplets are placed in contact with the substrate at the exact position where "injection" into the surface is required. The surface is ideally in condition to accept the ink. This may require specific preparation of the surface (mechanical and/or chemical). The ink droplet colors and/or sizes may also be adjusted according to color variations across the substrate. The frequent occurrence of faults on leather is preferably also considered when placing the image.

In view of the above, the process may be considered more similar to tattooing than conventional printing so that color management is non-standard. The substrate may have properties that other substrates conventionally printed on do not have: non-uniformity of color and other characteristics, prevalence of surface faults and the like. Preparation of the substrate surface improves acceptance of the ink and color management preferably assists overcome specific leather issues. Regarding more specifically the printing, parameters to be considered are temperature, time and pressure. Control of those parameters may take into consideration conflicting factors. Penetration and fixing of the acceptor, ink and additive preferably is achieved by heat and pressure. However, these two parameters can in some circumstances impact the characteristics of the substrate and ultimately even damage the substrate permanently. Ideally, therefore, minimum heat and/or minimum pressure are applied for a minimum time to achieve the forced penetration and fix the ink to produce a stable, robust image without degrading the leather qualities. Each type of leather may have a different set of desired parameters, which may be sensitive to thickness and which may range from e.g. about 0.4 mm (bookbinding) to e.g. about 8 mm (heavy industrial uses), i.e., variation by a factor of ×20.

Further consideration may be given to production of steam since leather has a high water content that may turn to steam under heat and pressure and rise through the substrate and impede the ink that may be trying to diffuse through the leather in the opposite direction. The impact of this effect may be reduced by presentation of the substrate in a selected condition, e.g., by dehydrating the substrate and using a mechanical process (e.g., vacuum removal of steam) during the printing. Measurement and analysis of each individual piece of substrate to be printed on, prior to printing, may be used to determine the desired parameters such as ink droplet size, color, heat pressure, time. For example, printing on stiff, pink 6 mm thick vegetable tanned leather for use in saddles may involve different parameters compared to soft, thin 1.5 mm goatskin for gloves or upholstery leather, or shoe leather.

Post-printing, conditioning of the printed leather may be performed. Having made various mechanical and/or chemical adjustments to the leather as detailed above, and having exposed the leather to heat and pressure, the leather may not be in an ideal condition to continue through to a finishing process line. Corrective mechanical and chemical processes such as re-hydration, fat-liquoring, rolling and the like, may therefore be applied to bring leather to a suitable condition for finishing. The following describes observed results.

A high definition, stable image was achieved. The ink appeared to be embedded into the surface of the substrate and this was shown to be the case after examination using an high magnification microscope. Furthermore, pieces of leather printed using a forced penetration mechanism exhibited no degradation or fading. Therefore, results of printing by forced penetration appear to be highly stable. The ink was dry at the time of heat pressing. However, a similar effect would be observed using a wet ink. In this regard, however, since it is advantageous to achieve a high definition image, it may be preferably in the case of wet ink placement to take steps to reduce blurring of the printed image. The following describe concepts relating to carrying out the above process, in particular concepts applicable to an industrial leather printing machine.

Having established that "forced penetration" yields good results, I designed a commercial process. Preferably, such a process may be one or more of the following: high volume, fast and/or robust; inexpensive; efficiency, e.g., low running/maintenance costs; low failure rates of printing; easy to use, e.g., controls are user friendly; and/or friendly to the environment, e.g., reduced impact relative to other finishes. Regarding environmental impact, since the process involves direct printing, toxic chemicals such as acetate, e.g., to remove plastic, may be avoided. Similarly, pollutants may be reduced by avoiding use of solvent based dyes.

The process can be broken down into stages, e.g.: tanning (this may involve providing a chemical treatment to the leather during the tanning process as described in further detail below); pre-print treatment (e.g., indentation of the leather and/or providing holders as described above); preparation for printing (e.g., dehydration, heating to drive off water content and/or to reduce change in dimensions upon later applying heat during printing) and/or cleaning (e.g., using ultra-sound); coating with the ink acceptor; scanning; printing; post-print treatment (e.g., reheating or ultra-violet scanning to fix the ink in the leather, e.g., to increase bonding of ink molecules to the leather); execution of control software (e.g., to determine ink droplet size dependent on a spatial variation of a property of leather across the piece of leather to be printed and/or to determine need for further treatment of the leather; for example, further dehydration treatment (e.g., heating) to reduce water content).

For each stage, there may be several options. For example, dehydration may comprise passing racks of leather through a dehydration oven with extractors to remove water/steam. Heating preferably continues at a temperature of about 70° C. until the water content has reduced to about 5% by weight. The time required may vary depending on size, thickness and tanning method applied to each batch. Cleaning may be achieved by warm blasting with a jet of warm air/$CO_2$ mix and/or a light buff mechanism to remove large or persistent pieces of dirt. Furthermore, these stages are not necessarily performed in any particular order, e.g., preparation for printing may occur before preprint treatment.

The following paragraphs describe selected apparatus and related processes. The leather may be tanned, e.g., using an additive to enhance the ink acceptability (preferably to lock in the ink) and print quality. The leather is treated (chemically/mechanically) for printing. For example, the leather may be dehydrated, pressed (e.g., if the leather was supplied in rolled-up or folded form), cleaned or the like. At this stage, the prepared leather may be suitable for storage in this state, preferably in "sandwich piles", i.e., with dust attracting sheets between adjacent leather layers or in a rack which separates layers to reduce transfer of leather dust between adjacent layers. Such a rack may be used as a transport mechanism to move piles of leather around and/or as a support when dehydrating the leather and/or as a feeder mechanism to a main machine/process line. It is efficient to do as much preparation as possible before the leather enters the actual print process. This may speed up printing and lower the risk of print line failure. The in-line printing stage preferably has a transport mechanism, e.g., flatbed and/or roller mechanism. Once the leather has entered the actual print process, final preparation for immediate printing is performed. This may involve mechanical treatment such as pre-heating to an optimal temperature. There may be chemical treatment applied, e.g., coating the surface of the leather with an ink acceptor. Generally, its purpose is to dry the ink and hold it in place for pressing.

Before printing, measurable characteristics that impact print quality are identified. The leather is scanned to: (a) measure these characteristics; (b) identify faults; (c) obtain a color profile; and (d) obtain a physical profile (area, shape). Characteristics that may be scanned for may include any one or more of, e.g., liquid content (e.g., water, oil or the like), pore concentration, flatness, thickness, color and the like. Faults that may be scanned for may include any one or more of creases, cuts and scratches, holes, bite marks or the like. A calibrated visual profile may provide a color map of the substrate according to the scan results. Physical measurements may be required for the scanning, e.g., spectroscopy to detect content, photography to detect color, distance or weight measurements to detect thickness, distance measurements to detect flatness, light transmissivity to detect thickness and/or pore concentration, passed by an ultrasound sensor (e.g., to detect water content) and the like. It is noted that scanning for faults and adjusting the printing on this basis may reduce waste.

The scan may discover information on which basis the print parameters (e.g., ink droplet size and/or color) can be adjusted to improve print quality and efficiency. The scan may generate a layered digital profile of the substrate showing on respective layers color, water density and location of any faults/blemishes/creases and the like. Through the control software, adjustments may be made to the ink color and volume, as well as control of temperature, pressure and/or time of pressing. The front end image control software preferably highlights problem areas and faults to allow the operator to place the required image efficiently. This may be automated as desired.

After a process as described above has been carried out, the leather may thus have been tanned and pre-treated in a way to improve print quality and efficiency. From appropriate storage, it has preferably entered the in-line print process and prepared for printing. This includes applying a base coat of ink acceptor. It has further preferably been scanned to obtain data for the image and machine control software. The desired image is placed (by the machine operator or automatically) on the scanned profile of the leather on the front end software application. This may minimize the impact of faults and maximize the usable area. The ink is then placed between the leather and the pressing barrier. There are various options, e.g.: (a) the ink is placed on the prepared substrate; (b) the ink is placed on the barrier; and/or (c) the ink is place on a carrier such as paper or film or "mesh" e.g., a flexible wire mesh and has holders/holding agent, e.g., the wires of the mesh themselves acting as mechanical ink holders. Advantageously, the carrier of option (c) is re-usable.

The method of ink placement can be based on known technology, preferably inkjet. However, ink volume (drop size), application temperature of the ink and other factors may be controlled in a new manner, and components of the print apparatus, e.g., print head, may be conventional (e.g., CMYK preferably arranged in parallel as in a conventional wide format printer) or unconventional, i.e., selected for my printing processes. Similarly, the ink may be a currently available ink, but preferably is an ink suitable for forced penetration and designed specifically to improve the new process, e.g., taking into account unique characteristics and organic nature of the substrate, preference for low temperature, pressure and the like.

Once the ink has been placed on the prepared substrate, a very fine layer of additive is placed over the entire surface, including areas where there is no ink. This is to achieve a substantially uniform finish with uniform performance over the whole substrate. The additive may be sprayed onto the surface in liquid suspension, dry (powder) form or may be spread as a liquid using a blade. The additive may be very fine (less than 0.0050 mm) and does not interfere with the ink.

Once the acceptor, ink and additive layer has been placed between the substrate and the barrier, the substrate is pressed and heated to a selected (i.e., predetermined) temperature and/or subjected to a selected pressure for an optimal time. These predetermined conditions are preferably calculated by the software. Printing by forced penetration then takes place. Application of ultra-sound may further assist penetration of the ink into the leather. Printing may occur by (preferably continuing on a flatbed conveyor journey past the scanning apparatus described herein) on a print bed. As it enters, the required image may be printed onto the prepared surface of the leather by continuous passing, for example, similar to wide format flatbed printing. The ink may dry upon contact with the prepared leather, for example, if the leather is warm, e.g., about 70° C. (having cooled after roll-embossing if this occurs). During printing of the image, a foil, e.g., a wide flexible foil that runs across the printing bed, covering the substrate, may be brought down to make contact with the substrate. A strong vacuum may be applied through the base of the printing bed to suck the foil tight onto the substrate.

A heated platen, e.g. operated by hydraulics, may then press the entire printing bed. The platen is then in contact with the foil and not directly with the substrate. Such foil may be used to protect the image from the platen surface. As an alternative to foil, non-porous paper or other non-porous, flexible material may be used. Thus, the foil/paper and platen form the above barrier. Heat and pressure may be applied for a specified time. These parameters may vary depending on the properties of the substrate (as determined by scanning). For example, for a "half-side" of 3 mm vegtan (4 ft×8 ft), suitable parameters may be: time: 15 s, pressure: 8 psi, temperature: 170° C.

After printing, the platen and foil are lifted and the vacuum released. The leather may continue along the conveyor and out of the printing bed. Re-setting the print mechanism for the next piece may involve replacing and/or cleaning the foil and/or platen. The main print mechanism preferably obtains good print quality and reliability, and preferably at the same time as maximized speed (e.g., throughput) and minimized failure rate.

While the process up to this point may have been generally flatbed (for preparation and scanning and maybe ink placement), heat pressing in particular may be accomplished by rollers and/or flatbed. There is also potentially a need for a vacuum during pressing. This could: (a) hold the leather in place during pressing; (b) remove excess water vapor; and/or (c) improve ink penetration by creating a pressure differential. After printing, the leather may be treated mechanically or chemically to: (a) fix the ink; and/or (b) return some of the characteristics (e.g., re-hydrate). The leather has at this point substantially completed its journey through the process and is now printed and in preferably an improved state (normal temperature, hydration levels, flexibility and the like). It may then continue through a conventional finishing process, e.g., grain embossing, protective coating, water-proofing and the like.

Advantageously, the process described above may allow printing of high definition, full color images into the surface of leather. Since the acceptor, ink and additive and is "injected" into the surface and fixed there (generally by attachment to collagen in the leather), it bonds well without the need for further coatings. The results may be a full color, robust digital print that is permanent and moves with the leather. The process can be industrialized to run at high speeds and be included in finishing production lines in tanneries. Regarding all of the above instances of software above, there may be provided software to perform image/color management and control the entire process. Such software may take account of known variables of the leather such as: type, average thickness, average density, average color, average size/dimension, average water content and the like. A sample from a batch to be printed may be pre-tested to establish any combination of these variables. The control software may then adjust printing parameters accordingly to improve print quality or output.

Such software may control rastor image processing (RIP), which may be calibrated so that it takes into account background colors. The type of output may be controlled, e.g., if the leather has natural color variations from growth, the processing may correct this. The RIP may control not only color but ink density, e.g., droplet size so that heavier coverage can be applied to areas that require it. The image/color management may include surface fault management. For example, a control screen may highlight areas where there are faults/blemishes. The software may be settable to move the pattern/image to best disguise/hide/avoid the faults, e.g., to maximize usage.

I further provide processor control code to implement the above described system and control procedures (e.g., any of the above instances of software), for example, on an embedded processor. The code may be provided on a carrier such as a disk, CD- or DVD-ROM, programmed memory such as read-only memory (Firmware), or on a data carrier such as an optical or electrical signal carrier. Code (and/or data) for implementation may comprise source, object or executable code in a conventional programming language (interpreted or compiled) such as C, or assembly code, code for setting up or controlling an ASIC (Application Specific Integrated Circuit) or FPGA (Field Programmable Gate Array), or code for a hardware description language such as VERILOG or VHDL (Very high speed integrated circuit Hardware Description Language). Such code and/or data may be distributed between a plurality of coupled components in communication with one another.

Any of the above descriptions/examples relating to the printing processes and/or printers may be used to print leather for a variety of applications, e.g., footwear, furniture, bags and luggage, accessories (gloves, belts, wallets and the like), clothing, automotive (e.g., train/plane/boat/car seats and the like), interiors, books and stationary, packaging, equestrian and the like.

Furthermore, the above-described may be applied in the same way to printing on non-leather substrates. No doubt many other effective alternatives will occur to those skilled in the art. It will be understood that this disclosure is not limited to the described examples and encompasses modifications apparent to those skilled in the art lying within the spirit and scope of the appended claims.

The invention claimed is:

1. Apparatus for printing leather comprising:

an ink acceptor applicator that applies ink acceptor directly onto a surface of the leather;

an ink applicator that applies ink to the ink acceptor and/or the leather surface;

an additive applicator that applies additive onto the ink acceptor, the ink and/or the leather surface;

a barrier having a surface configured to contact the ink acceptor, ink and additive on the leather surface; and a heater that heats the surface of the barrier to a predetermined temperature or a temperature within a selected temperature range such that the barrier, which is substantially impervious to the ink and has a melting point higher than the select temperature range, contacts at least the ink acceptor, ink and additive on the leather surface directly to soften the ink acceptor, ink and additive into the leather and the ink acceptor, ink and additive soften and penetrate into the leather.

2. The apparatus of claim 1, wherein a lowest temperature of the predetermined temperature range is higher than about 100° C.

3. The apparatus of claim 1, wherein a highest temperature of the predetermined temperature range is lower than about 220° C.

4. The apparatus of claim 1, further comprising a pressurizer that applies pressure directly onto the applied ink acceptor, ink and additive by pressing the heated barrier against the ink acceptor, ink and additive at a selected pressure.

5. The apparatus of claim 4, wherein the pressure is less than about 50 psi and more than about 0 psi.

6. The apparatus of claim 5, wherein the length of time is less than or equal to about 2 minutes.

7. The apparatus of claim 1, wherein the barrier is applied to the ink acceptor, ink and additive for a length of time within a predetermined time length range or for a predetermined time length.

8. The apparatus of claim 1, further comprising a heater that dehydrates the leather to cause water in the leather to become steam, and at least one of:

a vacuum suction device that sucks steam away from the leather; or an absorbing material that absorbs steam away from the leather.

9. The apparatus of claim 1, further comprising a scanner that determines spatial variation of at least one property of the leather, wherein the at least one property selected from the group consisting of liquid, protein, fat content, thickness, acidity, pore concentration, flatness, color and surface roughness, and wherein the scanner further detects fault(s) in the leather.

10. The apparatus of claim 9, further comprising a printer comprising an adjustor that adjusts a total volume of ink applied to a location of the leather, and/or size and/or color of an ink droplet to be deposited on the leather, adjustment being dependent on a result of determining spatial variation of the at least one property of the leather.

11. The apparatus of claim 10, wherein the adjustor increases ink droplet size and/or the total volume of ink at a region of the leather having greater damage or higher water content than a neighboring region of the leather.

12. The apparatuses of claim 9, further comprising a computer system comprising:

an input that inputs measurements of surface properties of a piece of leather;

an output that outputs scanning results;

data memory that stores the inputted measurements;

a program memory storing processor control code; and a processor coupled to the input, the output, the data memory and the program memory that loads and implements the processor control code.

13. The apparatus of claim 1, wherein the barrier is configured to hold the ink substantially in a fixed position during application of heat.

14. A method of printing into leather comprising:

applying ink acceptor directly to the surface of the leather;

applying ink directly onto the ink acceptor and/or the leather surface of the leather;

applying an additive to the ink acceptor, the ink and/or the leather surface;

heating a surface of a barrier which is substantially impervious to the ink to a selected temperature or a temperature within a selected temperature range; and contacting the heated barrier which has a melting point higher than the selected temperature range with the ink acceptor, additive and ink on the leather surface directly to soften the additive, ink acceptor and ink into the leather such that the ink penetrates into the leather.

15. The method of claim 14, further comprising mechanically treating the leather before application of the ink to hold the ink in a substantially fixed position during application of heat.

16. The method of claim 14, wherein a computer program controls the method.

17. The method of claim 14, wherein a computer system comprising an input that inputs measurements of surface properties of a piece of leather;

an output that outputs scanning results, the scanning results from a scanner that determines spatial variation of at least one property of the leather;

data memory that stores the inputted measurements;

a program memory storing processor control code; and a processor coupled to the input, the output, the data memory and the program memory that loads and implements the processor control code, wherein the code, when running, implements the method.

* * * * *